US008357294B2

(12) United States Patent
Danov et al.

(10) Patent No.: US 8,357,294 B2
(45) Date of Patent: Jan. 22, 2013

(54) DEVICE FOR SEPARATING FERROMAGNETIC PARTICLES FROM A SUSPENSION

(75) Inventors: Vladimir Danov, Erlangen (DE); Bernd Gromoll, Baiersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/998,116

(22) PCT Filed: Jul. 20, 2009

(86) PCT No.: PCT/EP2009/059308

§ 371 (c)(1),
(2), (4) Date: May 10, 2011

(87) PCT Pub. No.: WO2010/031616

PCT Pub. Date: Mar. 25, 2010

(65) Prior Publication Data

US 2012/0012512 A1 Jan. 19, 2012

(30) Foreign Application Priority Data

Sep. 18, 2008 (DE) ..... 10 2008 047 841

(51) Int. Cl.
*B03C 1/02* (2006.01)

(52) U.S. Cl. ..... 210/222; 210/695; 210/808; 210/416.1; 209/232

(58) Field of Classification Search ..... 210/695, 210/805, 808, 194, 222, 416.1; 209/214, 209/232

See application file for complete search history.

(56) References Cited

U.S. PATENT DOCUMENTS

| | | | | |
|---|---|---|---|---|
| 4,116,839 | A | 9/1978 | Unkelbach et al. | |
| 4,239,619 | A * | 12/1980 | Aplan et al. | 209/214 |
| 4,306,970 | A | 12/1981 | Tanaka et al. | |
| 4,921,597 | A | 5/1990 | Lurie | |
| 4,961,841 | A * | 10/1990 | Andres et al. | 209/214 |

FOREIGN PATENT DOCUMENTS

| | | |
|---|---|---|
| DE | 26 51 137 A1 | 5/1977 |
| DE | 30 13 635 | 10/1980 |
| DE | 41 24 990 A1 | 1/1993 |
| DE | 102008047841.5 | 9/2008 |
| FR | 2 341 367 A1 | 9/1977 |
| GB | 1 599 823 | 10/1981 |
| JP | 52-86566 | 7/1977 |
| WO | 02/07889 A2 | 1/2002 |

OTHER PUBLICATIONS

Written Opinion for Parent PCT Appliication No. PCT/EP/059308, dated Mar. 12, 2009.*

International Search Report for Application No. PCT/EP2009/059308; mailed Mar. 12, 2009.

* cited by examiner

*Primary Examiner* — David A Reifsnyder
(74) *Attorney, Agent, or Firm* — Staas & Halsey LLP

(57) ABSTRACT

Ferromagnetic particles are separated from a suspension using a tubular reactor having at least one magnet, where a suspension is able to flow through the reactor. A displacer is arranged inside the reactor.

9 Claims, 2 Drawing Sheets

DEVICE FOR SEPARATING FERROMAGNETIC PARTICLES FROM A SUSPENSION

CROSS REFERENCE TO RELATED APPLICATIONS

This application is the U.S. national stage of International Application No. PCT/EP2009/059308, filed Jul. 20, 2009 and claims the benefit thereof. The International Application claims the benefits of German Application No. 102008047841.5 filed on Sep. 18, 2008, both applications are incorporated by reference herein in their entirety.

BACKGROUND

Described below is a device for separating ferromagnetic particles from a suspension, using a tubular reactor through which the suspension can flow and which has at least one magnet.

In order to extract ferromagnetic components which are contained in ores, the ore is ground into a powder and the powder obtained is mixed with water. A magnetic field generated by one or more magnets is applied to this suspension, as a result of which the ferromagnetic particles are attracted so that they can be separated from the suspension.

DE 27 11 16 A discloses a device for separating ferromagnetic particles from a suspension, in which a drum consisting of iron rods is used. The iron rods are alternately magnetized during the rotation of the drum, so that the ferromagnetic particles adhere to the iron rods while other components of the suspension fall down between the iron rods.

DE 26 51 137 A1 discloses a device for separating magnetic particles from an ore material, in which the suspension is fed through a tube which is surrounded by a magnetic coil. The ferromagnetic particles accumulate at the edge of the tube, while other particles are separated through a central tube which is located inside the tube.

A magnetic separator is described in U.S. Pat. No. 4,921,597 B. The magnetic separator includes a drum, on which a multiplicity of magnets are arranged. The drum is rotated oppositely to the flow direction of the suspension, so that ferromagnetic particles adhere to the drum and are separated from the suspension.

A method for the continuous magnetic separation of suspensions is known from WO 02/07889 A2. This uses a rotatable drum in which a permanent magnet is fastened, in order to separate ferromagnetic particles from the suspension.

In known devices, a tubular reactor, through which the suspension flows, is used to separate the ferromagnetic particles from the suspension. One or more magnets, which attract the ferromagnetic particles contained in it, are arranged on the outer wall of the reactor. Under the effect of the magnetic field generated by the magnets, the ferromagnetic particles migrate onto the reactor wall and are held by the magnet arranged on the outside of the reactor.

FIG. 1 shows the profile of the force of attraction as a function of the radial position in a known device. The distance from the middle of the reactor is plotted on the horizontal axis, the dot and dash line corresponding to the midline of the reactor. The force of attraction is plotted on the vertical axis. The force of attraction, which is proportional to the magnetic field gradient, has a parabolic profile, is minimal at the center of the reactor and maximal on the inner wall of the reactor. Accordingly, particles which are located in the middle of the reactor are not attracted, or only partially attracted, by the magnet or magnets and subsequently separated from the suspension. In particular with high speeds, this effect means that a considerable part of the suspension flowing through the reactor is not attracted to the inner wall of the reactor, and leaves the reactor again without the ferromagnetic particles being separated. For this reason, the separation ratio in known devices is unsatisfactory with significant flow rates.

SUMMARY

It is therefore an aspect to provide a device for separating ferromagnetic particles from a suspension, which delivers a satisfactory yield even with significant flow rates.

In order to achieve this, in a device of the type mentioned in the introduction, a displacer is arranged in the interior of the reactor.

In contrast to known reactors, which are usually formed in the shape of a tube, the flow cross section of the device described herein is annular, which may be achieved by the displacer arranged centrally inside the reactor. The effect of the displacer is that the suspension flowing through the reactor flows close to the wall of the reactor, so that virtually all the ferromagnetic particles lie in the region of influence of the magnetic field or magnetic fields. Accordingly, in the device, particles are prevented from flowing through the middle of the reactor and therefore being unable to be attracted. In comparison with known devices, a substantially better separation ratio is achieved with the device described herein by the displacer Mar. 18, 2011 ably formed as a tube.

In another configuration, the reactor may have at least one suction line branching off from the reactor, to which a negative pressure can be applied and which is surrounded by a permanent magnet in the region of the branching.

In the device, separated ferromagnetic particles can be extracted through the suction line and thereby separated from the suspension. The device described herein therefore has the advantage that the reactor does not need to be stopped in order to remove the ferromagnetic particles from the suspension. Accordingly, the separation of the ferromagnetic particles can be carried out continuously with the device.

According to a refinement, the permanent magnet may be surrounded by a coil winding which allows magnetic field control. The magnetic field of the permanent magnet can be increased or decreased by the magnetic field control. In this way, it is possible to adapt the region of influence inside which ferromagnetic particles are attracted, and subsequently separated from the suspension via the suction line.

The device described herein may particularly advantageously comprise a plurality of suction lines arranged successively in the flow direction, each of which is surrounded by a permanent magnet in the region of the branching. The plurality of suction lines may be arranged in cascade fashion in the flow path of the suspension, so that further ferromagnetic particles are removed from the suspension as the suspension flows through the reactor.

The device described herein may also have a plurality of suction lines arranged distributed in the circumferential direction of the reactor, each of which is surrounded by a permanent magnet in the region of the branching. With such an arrangement, virtually the entire flow cross section can be exposed to a magnetic field so that a very large fraction of the ferromagnetic particles contained in the suspension can be removed from the suspension by the suction lines.

In particular, each suction line of the device may include a controllable shut-off valve. Each shut-off valve can be opened and closed by a control device. When a shut-off valve is opened, the ferromagnetic particles which have accumulated under the effect of the magnetic field enter the suction line owing to the negative pressure and can be collected at another position. The negative pressure may, for example, be generated by a pump or the like.

A plurality of suction lines may also be connected together. Suction lines connected together can be used simultaneously to suction accumulated ferromagnetic particles by opening the associated shut-off valves simultaneously. If a plurality of suction lines are connected together, a single negative pressure generation device, for instance a pump, is sufficient in order to suction the ferromagnetic particles from all the suction lines.

BRIEF DESCRIPTION OF THE DRAWINGS

These and other aspects and advantages will become more apparent and more readily appreciated from the following description of the exemplary embodiments, taken in conjunction with the accompanying drawings of which.

DETAILED DESCRIPTION OF THE PREFERRED EMBODIMENT

Figure 1:
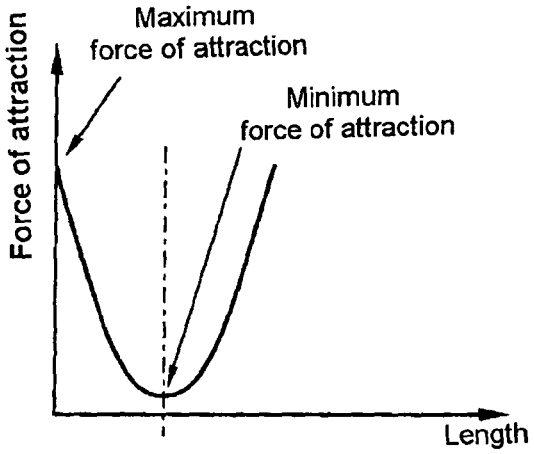
FIG. 1 is a graph in which the force of attraction as a function of the radial position is represented for a known device.

Reference will now be made in detail to the preferred embodiments, examples of which are illustrated in the accompanying drawings, wherein like reference numerals refer to like elements throughout.

Figure 2:
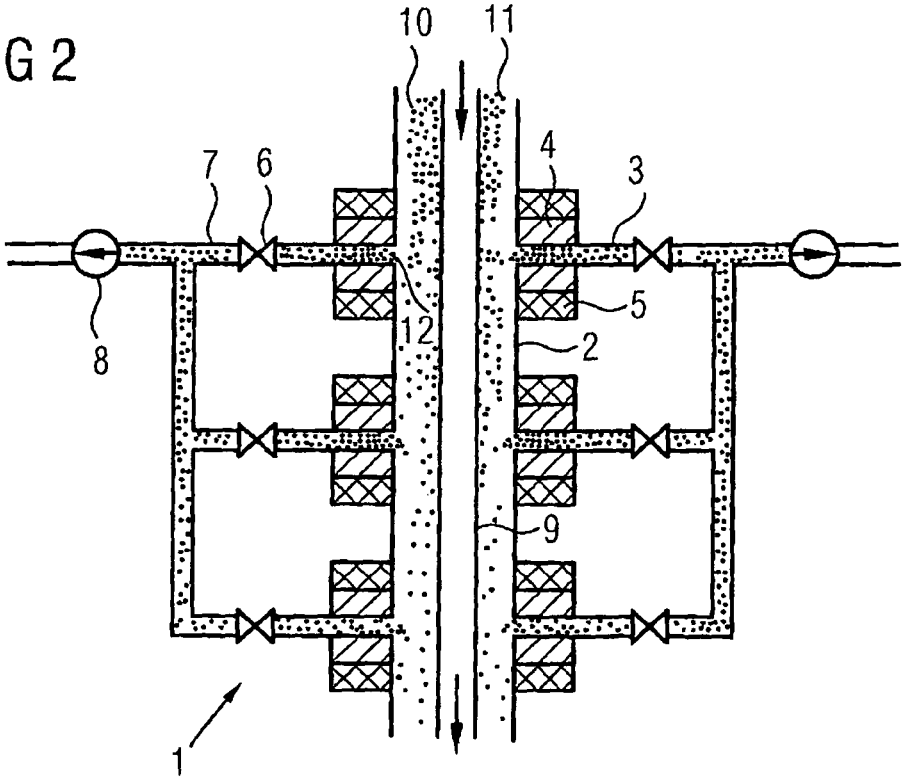
Prior art FIG 2
FIG. 2 is a fluid flow diagram of a first exemplary embodiment.

The device 1 shown in FIG. 2 includes a tubular reactor 2, which has a plurality of suction lines 3. The reactor 2 has a plurality of suction lines 3 arranged successively in the flow direction; two suction lines 3 lie opposite one another in each case.

Each suction line 3 is surrounded by an annularly formed permanent magnet 4. Each permanent magnet 4 is surrounded by a coil winding 5, with which the magnetic field generated by the permanent magnet 4 can be amplified or attenuated. The coil windings 5 are connected to a control device (not shown).

Each suction line 3 can be closed and opened by a shut-off valve 6. The various suction lines 3 open into suction lines 7, in each of which there is a pump generating a negative pressure.

A displacer 9 is arranged centrally inside the reactor 2. In the exemplary embodiment represented, the displacer 9 is formed as a tube, although in other exemplary embodiments it may also be formed as a solid cylinder. Owing to the displacer 9, the flow cross section in the device 1 shown in FIG. 2 is annular. Even if the magnetic particles lie on the surface of the displacer 9, they are subjected to the effect of the magnetic field generated by the permanent magnets 4, so that the ferromagnetic particles are attracted toward the permanent magnet 4 and adhere at this position.

The arrows in FIG. 2 indicate the flow direction of the suspension. A suspension 11 is applied to the inlet 10 of the reactor 2. This suspension typically includes water, ground ore and optionally sand. The particle size of the ground ore may vary.

Under the effect of the magnetic fields of the permanent magnets 4, ferromagnetic particles 12 are deposited on the inner side of the reactor in the region of the permanent magnets 4, as shown in FIG. 2. These deposits form on all the permanent magnets 4, which are arranged successively in the flow direction in the reactor 2. When the shut-off valves 6 are opened—as shown in FIG. 2—the ferromagnetic particles pass through the suction lines 6, owing to the negative pressure generated by the pump 8, into suction lines 7, so that the ferromagnetic particles can be separated from the suspension 11 and collected in a storage container. The strength of the magnetic fields of the permanent magnets 4 can be controlled by the coil windings 5, that is to say the magnitude of the magnetic fields can be increased or decreased. The suction of the ferromagnetic particles takes place with a reduced magnetic force by the coil windings 5 being controlled accordingly.

Other non-ferromagnetic particles, which are contained in the suspension, or other components such as sand, flow axially through the reactor 2 without being affected.

Figure 3:
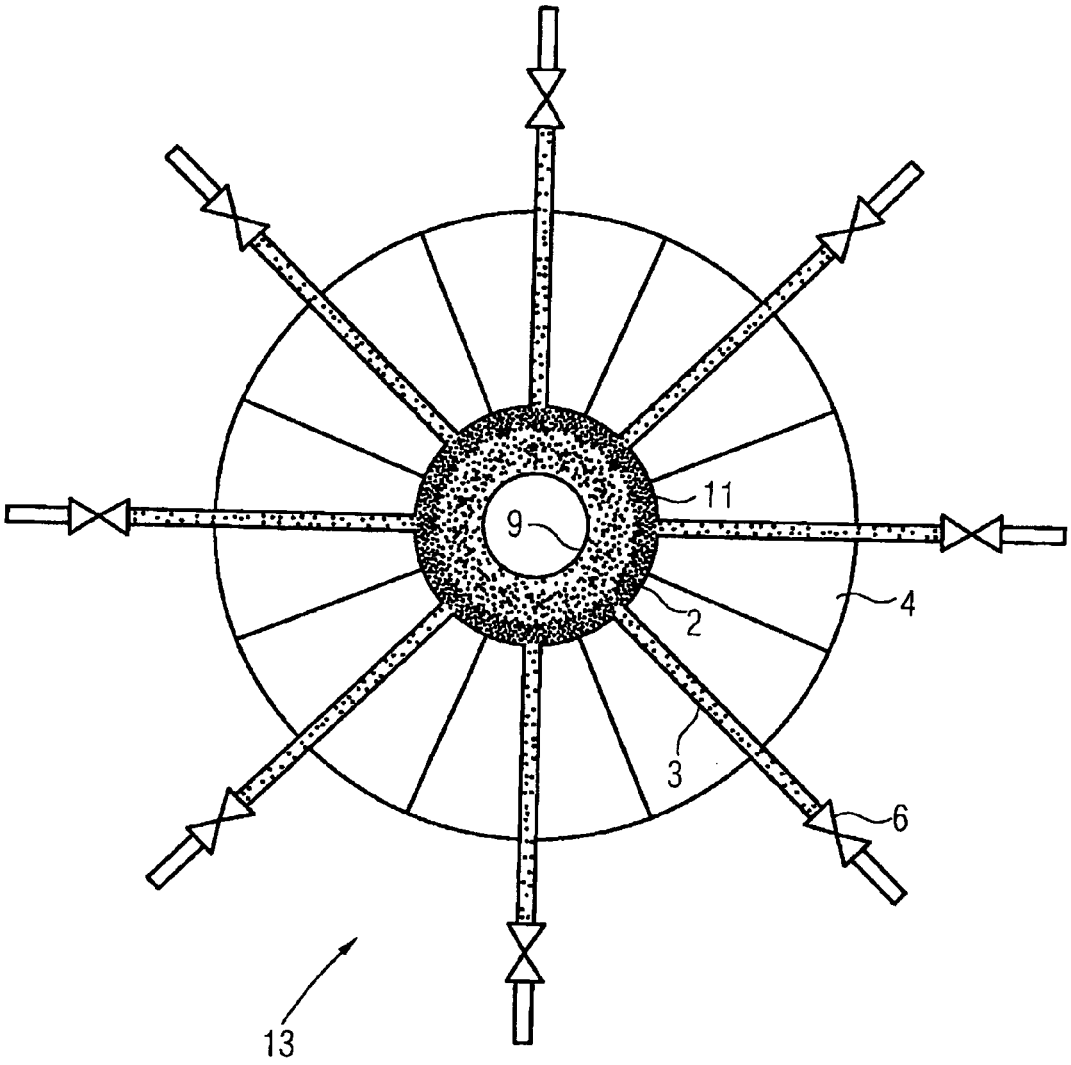
FIG. 3 is a fluid flow diagram of a second exemplary embodiment.

FIG. 3 shows a second exemplary embodiment of a device for separating ferromagnetic particles from a suspension, components which are the same being provided with the same references.

The device 13 includes a reactor 2, inside which there is a centrally arranged displacer 9. A plurality of suction lines 3 open radially in the shape of a star into the reactor 2. In the region of the branching of the suction lines 3 from the reactor 2, there are segmentally arranged permanent magnets 4. The permanent magnets 4 are segment-polarized. In accordance with the device shown in FIG. 2, each suction line 3 is provided with a controllable shut-off valve 6. Using a negative pressure generation device (not shown in FIG. 3), for instance a pump, with open shut-off valves 6 the magnetically separated part can be suctioned from the suspension and subsequently removed.

In FIG. 3, it can be seen that the suspension 11 is located in an annular gap between the outer side of the displacer 9 and the inner side of the reactor 2. With the device 13, a high separation ratio and therefore a good yield can be achieved even with significant flow rates A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. A device for separating ferromagnetic particles from a suspension, comprising:

a tubular reactor through which the suspension can flow;

at least one suction line branching off from said reactor;

at least one magnet adjacent at least one of said at least one suction line; and a displacer arranged inside said reactor.

2. The device as claimed in claim 1, wherein said displacer is arranged centrally inside said reactor.

3. The device as claimed in claim 2, wherein said displacer has a tubular shape.

4. The device as claimed in claim 3, wherein the at least one magnet includes a permanent magnet surrounding each of said at least one suction line only in a region of the branching.

5. The device as claimed in claim 3, further comprising at least one coil winding, each surrounding a corresponding permanent magnet included in said at least one magnet, capable of providing magnetic field control.

6. The device as claimed in claim 5, wherein said at least one suction line includes a plurality of suction lines arranged successively in a flow direction, and wherein said at least one magnet includes a plurality of permanent magnets, each respectively surrounding one of the suction lines in the region of the branching.

7. The device as claimed in claim 5, wherein the plurality of suction lines are distributed in a circumferential direction of said reactor.

8. The device as claimed in claim 7, wherein each of the plurality of suction lines includes a controllable shut-off valve.

9. The device as claimed in claim 8, wherein a group of said suction lines are connected together.

* * * * *